US005720381A

United States Patent [19]

Betancourt

[11] Patent Number: 5,720,381

[45] Date of Patent: Feb. 24, 1998

[54] FLAT PACK ITEM STORAGE

[76] Inventor: Gabriel J. Betancourt, 2055 SW. 122 Ave., Apt. 521, Miami, Fla. 33175

[21] Appl. No.: 797,500

[22] Filed: Feb. 7, 1997

[51] Int. Cl.[6] ..... A45C 11/32

[52] U.S. Cl. ..... 206/0.8; 206/37.1; 206/39; 206/818

[58] Field of Search ..... 206/0.8, 0.82, 206/0.83, 0.84, 38, 38.1, 449, 555, 37, 37.1, 37.4, 39, 818

[56] References Cited

U.S. PATENT DOCUMENTS 3,212,546 10/1965 Lind ..... 150/40
4,037,716 7/1977 Marks ..... 206/38
4,457,425 7/1984 Cooper et al. ..... 206/38
5,328,026 7/1994 Newman ..... 206/38 X

*Primary Examiner*—Jacob K. Ackun
*Attorney, Agent, or Firm*—Robert C. Kain, Jr.

[57] ABSTRACT

The storage cache is utilized to contain, in an interior cavity, flat items such as keys, flat stamps, coins and other small flat items. The storage cache is a multiple layer, flat pack, composite unit. At least two of these layers are flexible magnetic material. One of these magnetic layers has a cut-out cavity sized to contain the flat item. In one embodiment, the storage cache includes a top and bottom layer of flexible plastic material which is translucent. The translucent plastic enables the user to see into the cavity in order to determine whether the storage cache carries the key, stamp and/or coin. Other embodiments include a view passage rather than a translucent plastic covering layers.

18 Claims, 2 Drawing Sheets

FLAT PACK ITEM STORAGE

BACKGROUND OF THE INVENTION

The present invention relates to a storage cache for small, flat items such as keys, stamps, coins or other small items.

OBJECTS OF THE INVENTION

It is an object of the present invention to provide a storage cache for small, flat items.

It is another object of the present invention to provide a multiple layer, flat pack with flat, planar elements which are releasably held together by magnetic fields developed by one or more of the layered elements forming the flat pack.

It is a further object of the present invention to provide, in one embodiment, a storage cache formed by a cavity in juxtaposed layers and having a view port such that the user can see whether the storage cache cavity holds the flat key, stamp, coin or other flat item.

It is an additional object of the present invention to provide a storage cache which includes at least two layers of flexible magnetic material and at least one layer of flexible plastic material, which, in one embodiment, is translucent such that the user can see through the plastic layer in order to determine whether the flat item is stored in the cache.

It is a further object of the present invention to provide a storage cache wherein both magnetic layers have cut-out storage cavities.

It is an additional object of the present invention to provide a storage cache wherein plastic top and bottom layers are, in fact, a single unitary layer such that the plastic wraps around one edge of the flat pack storage cache.

SUMMARY OF THE INVENTION

The storage cache is utilized to contain, in an interior cavity, flat items such as keys, flat stamps, coins and other small flat items. The storage cache is a multiple layer, flat pack, composite unit. At least two of these layers are flexible magnetic material. One of these magnetic layers has a cut-out cavity sized to contain the flat item. In one embodiment, the storage cache includes a top and bottom layer of flexible plastic material which is translucent. The translucent plastic enables the user to see into the cavity in order to determine whether the storage cache carries the key, stamp and/or coin. Other embodiments include a view passage rather than a translucent plastic covering layers.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a storage cache for small, flat items. The following Flat Storable Item Table gives a partial list of flat items that are customarily carried by persons. The Table is only illustrative in nature and should not be considered to encompass all flat, storable items.

Flat Storable Item Table keys
stamps
coins
folded paper money
pictures
needles

Figure 1:
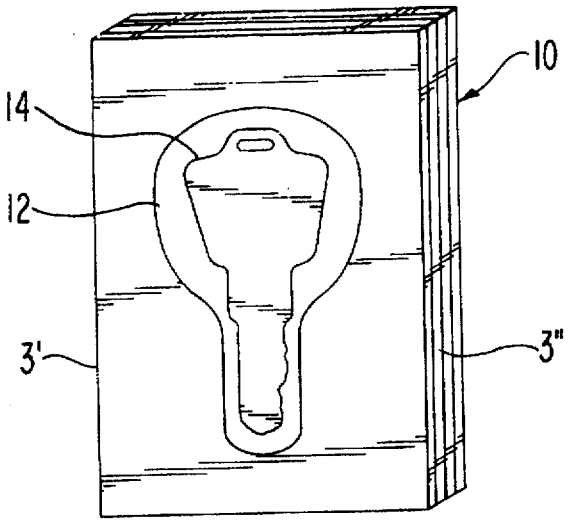
FIG. 1 diagrammatically illustrates the storage cache for small, flat items, formed by multiple layers in a flat pack, composite unit.
Figure 2:
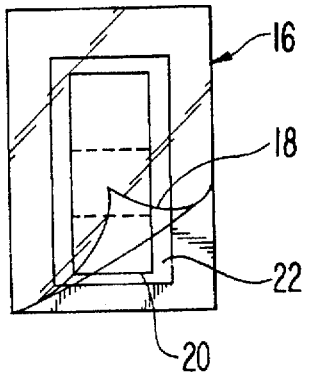
FIG. 2 diagrammatically illustrates the storage cache wherein the top or upper layer is partially withdrawn or lifted from the balance of the flat pack composite unit thereby exposing a stamp (the flat, stored item) contained in the interior cavity of the storage cache.

FIG. 1 diagrammatically illustrates storage cache 10 which contains, in an interior cavity 12 a key 14. FIG. 2 diagrammatically illustrates storage cache 16 wherein an upper translucent plastic layer 18 has been pulled back to partially reveal postal stamps 20 disposed in interior cavity 22.

Figure 3:
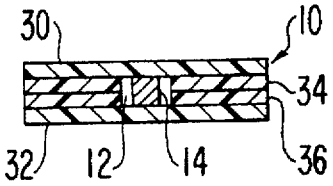
FIG. 3 diagrammatically illustrates a cross sectional view of the storage cache from the perspective of section line 3'–3" in FIG. 1.

FIG. 3 diagrammatically illustrates a cross sectional view of storage cache 10 from the prospective of section line 3'–3" in FIG. 1. In the illustrated embodiment, storage cache 10 includes an upper layer 30 and a lower layer 32, both made of flexible, translucent, plastic. Interior layers 34 and 36 are made of flexible, magnetic material. The magnetic layers 34, 36 remain together due to the magnetic lines of force between the two layers. Key 14 is disposed in interior cache cavity 12. Since top and bottom layers 30, 32 are made of flexible, translucent, plastic material, the user can see into interior cavity 12 in order to ascertain whether key 14 is present in the storage cache.

Figure 4:
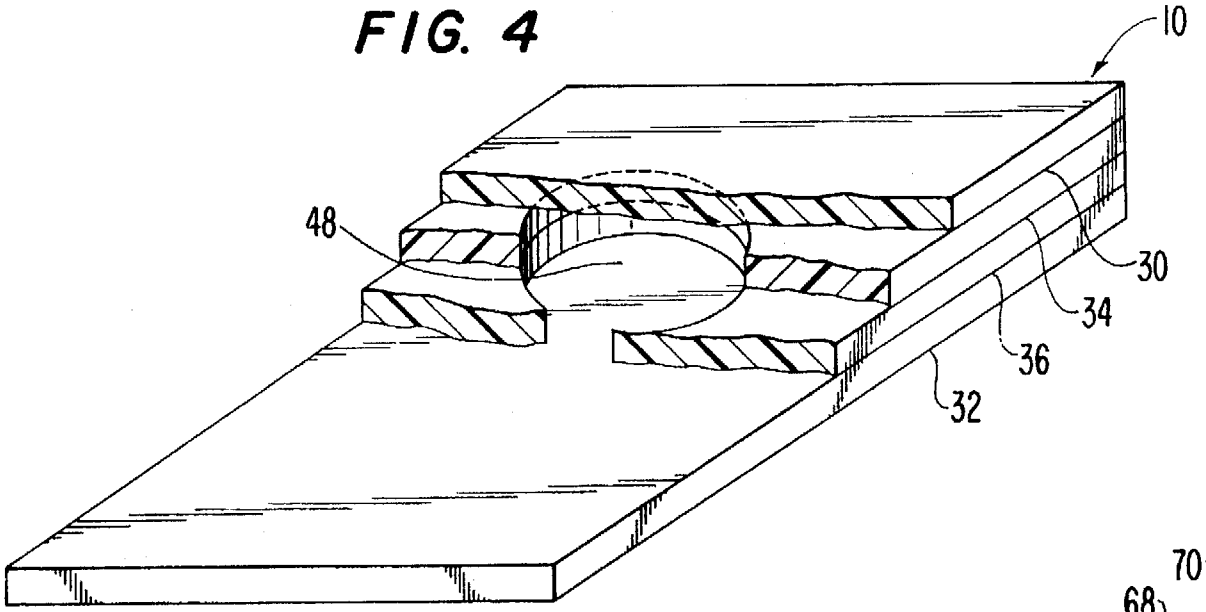
FIG. 4 diagrammatically illustrates a partial, broken away view of the storage cache and particularly illustrates the multiple layer structure of the storage cache.

FIG. 4 diagrammatically illustrates a partial, broken away, view of storage cache 10. In the illustrated embodiment, upper and lower layers 30, 32 are translucent plastic. Intermediate magnetic layers 34, 36, sandwiched between plastic layers 30, 32, define a cylindrical cavity 48.

It should be noted that each layer of the multiple layer, flat pack, composite unit has substantially the same peripheral dimensions. In other words, the flat pack composite unit, when all the layers are stacked one on top of another, forms a structure that has the same peripheral dimensions as each independent layer. Of course, the storage cache could define a square, rectangle, ellipsoid, circular, oval or other type of generally uniplanar structure. The claims appended hereto are meant to cover such modifications.

Figure 5:
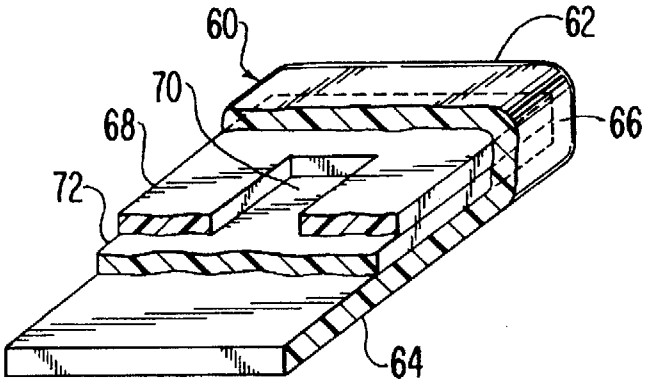
FIG. 5 diagrammatically illustrates the storage cache wherein the upper and lower flexible plastic layers are unitary and the unitary covering wraps around one end of the storage cache; and, FIG. 6 diagrammatically illustrates another embodiment wherein a view port is cut in the upper layer thereby eliminating the need for translucent plastic outer layers.

FIG. 5 diagrammatically illustrates storage cache 60 wherein the upper layer 62 and the lower plastic layer 64 are in fact a single, one piece, unitary layer wherein a portion 66 of that outside plastic covering wraps around a side or an end of storage cache 60. In addition, FIG. 5 diagrammatically illustrates an embodiment when intermediate magnetic layer 68 defines a cut-out 70 and lower magnetic layer 72 does not include such a cut-out.

Figure 6:
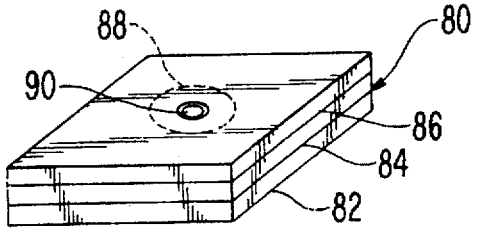

FIG. 6 diagrammatically illustrates storage cache 80 consisting of layers 82, 84 and 86. Layer 84 defines an interior cavity 88. Top layer 86 includes a view port 90 such that the user can see through the view port and into cavity 88 in order to determine whether the small, flat item is stored in cavity 88. In this embodiment, upper and lower layers 86, 82 are not necessarily translucent, plastic material.

The plastic layers 30,32 are retained either by static electricity or by the magnetic field.

The claims appended hereto are meant to cover modifications and changes within the spirit and scope of the present invention.

What is claimed is:

1. A storage cache for small, flat items such as a key, one or more flat stamps, coinage, comprising:

a multiple layer, flat pack, composite unit, each layer of said composite unit having substantially the same peripheral dimensions and each layer stacked atop one another;

said multiple layer composite unit held together by magnetic forces;

two layers being made of flexible magnetic material a juxtaposed atop one another such that magnetic lines of force releasably hold both layers together;

at least one magnetic layer having a cut-out sized to contain said small, flat item in its cut-out cavity;

a top and a bottom layer of flexible plastic material, at least one of said plastic layers being translucent and providing a view to said cavity in said cut-out magnetic layer;

whereby a user can see into said cavity in order to ascertain whether said flat item is stored within said cache; and whereby said user can open said storage cache by lifting one of said top and bottom plastic layers and one of said two magnetic layers to expose said cavity and insert or remove said small item from said storage cache.

2. A cache as claimed in claim 1 wherein each layer, when stacked atop one another, defines a substantially singular periphery for said flat pack composite unit.

3. A cache as claimed in claim 1 wherein both magnetic layers have cut-out cavities which hold said small items.

4. A cache as claimed in claim 1 wherein said flat pack composite unit is flexible.

5. A cache as claimed in claim 1 wherein said cavity is slightly larger in size than said small flat items.

6. A cache as claimed in claim 2 wherein both magnetic layers have cut-out cavities which hold said small items.

7. A cache as claimed in claim 6 wherein said flat pack composite unit is flexible.

8. A cache as claimed in claim 7 wherein said cavity is slightly larger in size than said small flat items.

9. A storage cache for small, flat items such as a key, one or more flat stamps, coinage, comprising:

a multiple layer, flat pack, composite unit, each layer of said composite unit having substantially the same peripheral dimensions and each layer stacked atop one another;

said multiple layer composite unit held together by magnetic forces;

two layers being made of flexible magnetic material a juxtaposed atop one another such that magnetic lines of force releasably hold both layers together;

at least one magnetic layer having a cut-out sized to contain said small, flat item in its cut-out cavity;

a covering layer of flexible plastic material which is translucent and provides a view to said cavity in said cut-out magnetic layer;

whereby a user can see into said cavity in order to ascertain whether said flat item is stored within said cache; and whereby said user can open said storage cache by separating said layers against the force of said magnetic lines of force.

10. A cache as claimed in claim 9 wherein each layer, when stacked atop one another, defines a substantially singular periphery for said flat pack composite unit.

11. A cache as claimed in claim 10 wherein said flat pack composite unit is flexible.

12. A cache as claimed in claim 11 wherein said cavity is slightly larger in size than said small flat items.

13. A storage cache for small, flat items such as a key, one or more flat stamps, coinage, comprising:

a multiple layer, flat pack, composite unit, each layer of said composite unit having substantially the same peripheral dimensions and each layer stacked atop one another;

said multiple layer composite unit held together by magnetic forces;

two layers being made of flexible magnetic material a juxtaposed atop one another such that magnetic lines of force releasably hold both layers together;

at least one magnetic layer having a cut-out sized to contain said small, flat item in its cutout cavity;

a covering layer of flexible plastic material which has a view port and provides a view to said cavity in said cut-out magnetic layer;

whereby a user can see through said view port into said cavity in order to ascertain whether said flat item is stored within said cache; and whereby said user can open said storage cache by separating said layers against the force of said magnetic lines of force.

14. A cache as claimed in claim 12 wherein each layer, when stacked atop one another, defines a substantially singular periphery for said flat pack composite unit.

15. A cache as claimed in claim 14 wherein both magnetic layers have cut-out cavities which hold said small items and said composite unit includes a bottom cover plastic layer.

16. A cache as claimed in claim 12 wherein said flat pack composite trait is flexible.

17. A cache as claimed in claim 15 wherein said flat pack composite unit is flexible.

18. A cache as claimed in claim 14 wherein said cavity is slightly larger in size than said small flat items.

* * * * *